United States Patent [19]

Beltran

[11] Patent Number: 4,515,570

[45] Date of Patent: May 7, 1985

[54] ACCESSORY KIT FOR FLYING DISC TOY

[76] Inventor: Edward R. Beltran, 15 A. N. San Marcos Rd., Santa Barbara, Calif. 93111

[21] Appl. No.: 566,693

[22] Filed: Dec. 29, 1983

[51] Int. Cl.[3] ..... A63H 27/00

[52] U.S. Cl. ..... 446/47; 446/485; 362/191

[58] Field of Search ..... 446/47, 46, 485, 242, 446/48; 273/424, 425, 428; 362/186, 190, 191, 253

[56] References Cited

U.S. PATENT DOCUMENTS

| | | | |
|---|---|---|---|
| D. 199,852 | 12/1964 | Johmann et al. | D21/86 |
| 3,340,390 | 9/1967 | Imre | 362/191 |
| 3,745,697 | 7/1973 | Wang | 446/242 |
| 4,077,155 | 3/1978 | Bruntmyer | 446/46 |
| 4,171,704 | 10/1979 | Sarkis | 446/46 X |
| 4,209,936 | 7/1980 | Sklar | 446/46 |
| 4,301,616 | 11/1981 | Gudgel | 446/47 |
| 4,431,196 | 2/1984 | Kutnyak | 273/424 |

*Primary Examiner*—Mickey Yu

*Attorney, Agent, or Firm*—Kenneth J. Hovet

[57] ABSTRACT

A dome light and stabilizer fin accessory kit is provided for use with toy flying discs. A socket is attached to the top center portion of the flying disc and a plug is inserted therein. The plug contains either the dome light with battery or a stabilizer fin assembly. The stabilizer fin rotates about a pin connected through an aperture in the plug. The leading edge of the fin includes a counterbalance such as a weight or battery-powered lamp. The trailing end may include an adjustable rudder.

9 Claims, 7 Drawing Figures

ACCESSORY KIT FOR FLYING DISC TOY

BACKGROUND OF THE INVENTION

1. Field of the Invention

The present invention concerns an improvement in flying disc toys and, more particularly, to a novelty accessory kit for attachment to such toys.

2. Description of the Prior Art

Adapting flying disc toys with illuminating means has been a popular concept. This is especially true when such illumination operates to impart astral characteristics to the toy, thereby adding to the fun and excitement of use. U.S. Pat. Nos. 3,786,246; 3,948,523; 4,086,723; 4,248,010; 4,301,616 and 4,307,538 describe various means for illuminating disc-type throwing toys. Although undoubtedly effective in providing light, such means oftentimes involve complex circuitry or fiber optics and are single-purposed.

Similarly, U.S. Pat. Nos. 3,553,884; 4,209,936 and 4,246,720 set forth aerodynamic attachments such as tails and vanes to flying disc toys. Each attachment or appendage has its own particular connection and use for the purpose intended but, again, such are single-purposed, without versatility, and are expensive. Also, the attachments are generally permanent in nature.

SUMMARY OF THE INVENTION

A unique feature of the novelty accessory kit of the current invention resides in its ability to provide more than one mode of operation of a disc-type throwing toy. The accessory kit is provided with a central housing or socket that can be attached to the flat top of commonly used toy flying discs. Adaptor plug or core member means are then used to connect with a novelty device. As shown in the illustrative embodiments, this may be a dome light assembly or a rotatable fin (or airfoil) assembly. The dome light includes a battery and is self-contained with the adaptor plug functioning as an outer sleeve.

The fin assembly also makes use of the aforementioned adaptor plug wherein the plug is apertured for containing a pin that connects to an aerodynamic fin or airfoil. The fin rotates into alignment with the wind and direction of travel of the flying toy. It includes a front edge counterbalance means which may be a weight or portable light. The back edge may include a rudder for imparting varying flight paths to the toy.

DESCRIPTION OF PREFERRED EMBODIMENTS

Figure 1:
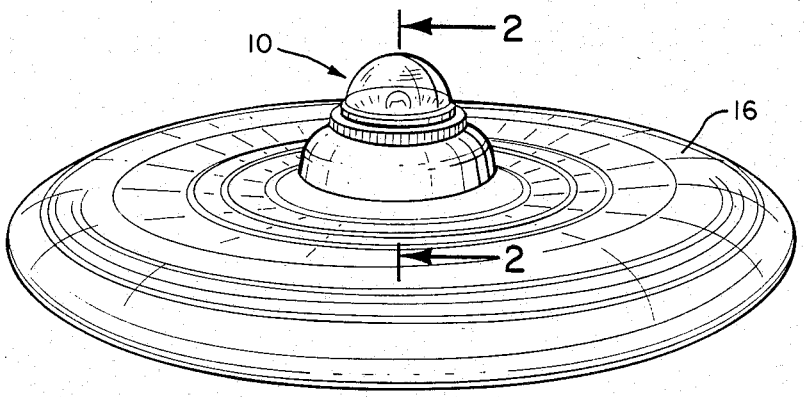
FIG. 1 is a perspective view of a typical flying disc toy to which has been affixed the dome light assembly of the present invention.
Figure 2:
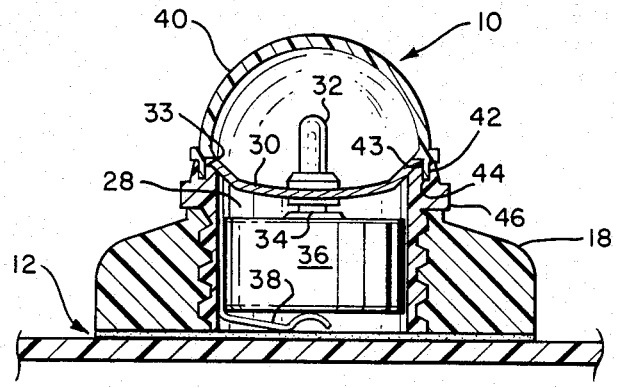
FIG. 2 is a fragmentary cross-section taken along lines 2—2 of FIG. 1.
Figure 3:
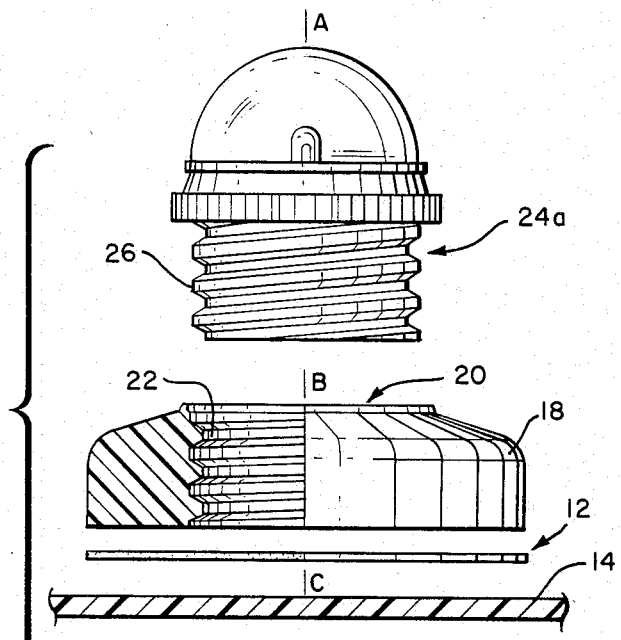
FIG. 3 is an exploded fragmentary cross-section view of FIG. 2.
Figure 4:
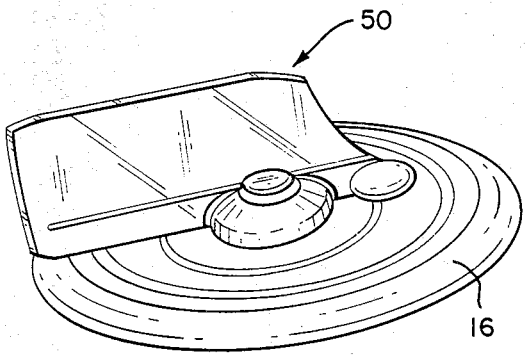
FIG. 4 is a perspective view of a typical flying disc toy having affixed thereto the fin assembly of the present invention.

With reference now to the drawings, two novelty devices are shown as illustrating unique features of the flying disc toy accessory kit of the present invention. FIGS. 1–3 depict a dome light assembly shown generally by reference numeral (10) affixed by connector means (12) to the generally flat top central portion (14) of a commonly used flying disc toy (16). The connector means preferrably should require no tools. Contact adhesive cement, pressure sensitive adhesive tape, two-sided adhesive discs, hoop and hook cloth fasteners known generally as Velcro are all satisfactory for purposes of this invention. Of course, mechanical fasteners such as snaps, pins, rivets, nuts, bolts and washers may also be used, but are less desirable requiring permanent alteration to the toy and the use of tools.

As shown in the drawings, base housing (18) forms the foundation element of the kit which is attached by the connector means directly to the top surface of the disc. The base housing is generally annular in shape and has a central opening (20). The housing is provided with internal threads (22) to form a socket for insertion of a plug means shown generally by reference numeral (24*a*). The plug means includes external threads (26) for corresponding engagement with the aforementioned housing threads (22) as best shown in FIG. 2. It further includes an upper rim having resilient engagement means in a manner to be hereinafter described.

The plug means is provided with an interior cavity (28). In the FIG. 2 embodiment, the interior cavity is large so that the plug means forms a sleeve-like member to house the battery-powered dome light assembly (10).

The dome light assembly includes a metallized reflector (30) through which extends bulb (32)—the bottom of which contacts positive electrode (34) of battery (36). Electrical conductor (38) connects the battery bottom negative pole to the bulb via the metallized reflector to complete the circuit and energize the bulb.

A dome (40) is provided which may be colored, shaded or apertured as dictated by consumer appeal. The dome includes an annular lip structure (42) adapted to engage a slot opening (44) in the rim (46) of the plug means (24*a*). The dome also includes an inner ledge (43) adapted to overlie the outer flange (33) of reflector (30). In this manner, when the lip (42) is in frictional engagement with slot (44), the reflector will be held firmly in place.

For simplicity's sake, no on-off switch has been shown for use with the dome light assembly. Such could be readily provided with a transversely extending cam member (not shown) operating to move the conductor (38) in and out of contact with the reflector (30). (Such is well known in the art.) Further, because the reflector is held in place by frictional engagement of the dome, such engagement can be readily loosened so that the bulb is lifted out of contact with the battery positive pole (34). In this way, the bulb can be de-energized without the expense of an on-off switch.

It will appreciated that the plug means containing the dome assembly forms one self-contained removable novelty means which may be conveniently exchanged with the fin assembly to be hereinafter described.

Referring now to FIGS. 4–7, fin assembly (50) is shown affixed to the flying disc toy (16). Such assembly comprises another form of accessory kit novelty means.

As previously described, connector means (12) is used to attach the bottom of base housing (socket) (18) to the center portion (14) of the flying disc toy. In this case, the plug or core member means (24*b*) is provided with a narrow aperture (52) as comprising the aforementioned interior cavity. The aperture is sized to closely correspond with the diameter of pivot pin (54) extending downwardly from aerodynamic fin (56).

Because of the relative rotation between the flying disc (16) and airfoil (56), washer (58) is positioned upon the upper surface (60) of rim (46). Preferrably, the airfoil is provided with round base member (62), the underside of which provides a wear surface for contact with the washer (58).

Figure 6:
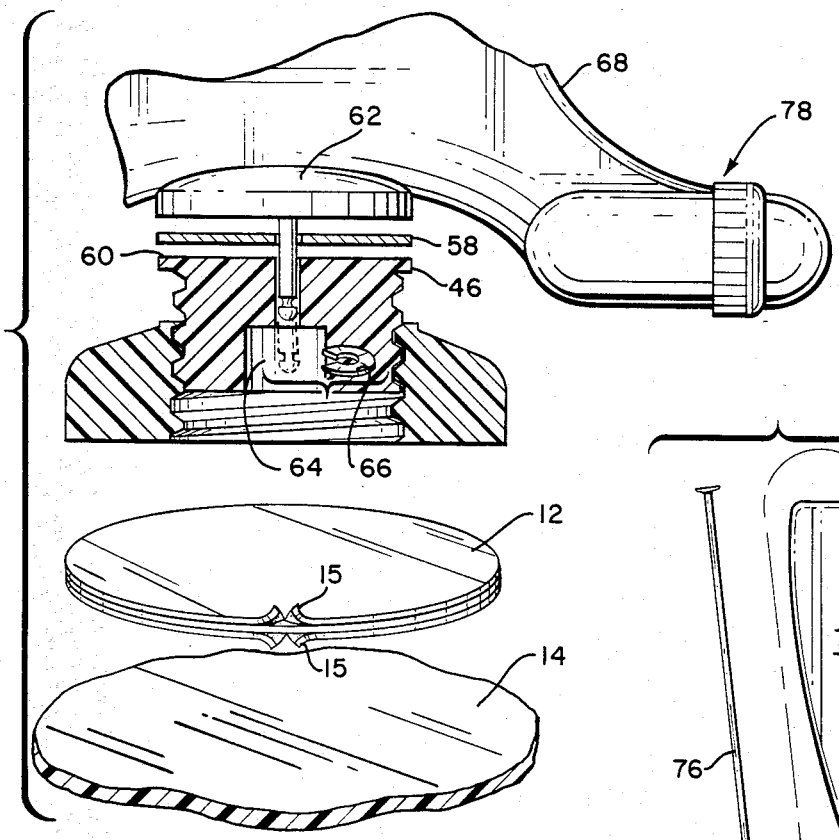
FIG. 6 is an enlarged-scale fragmentary exploded view of the fin assembly with a portable light as the counterbalance means.
Figure 7:
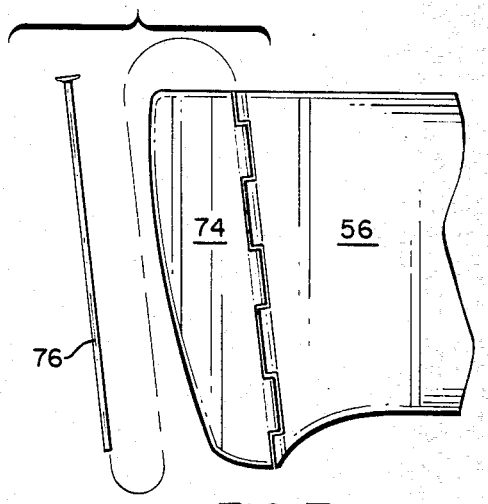
FIG. 7 is an enlarged-scale fragmentary assembly view of the back end of the fin showing a rudder attachment.

As best shown in FIG. 6, pivot pin (54) extends downwardly through washer (58) into aperture (52) until the end thereof reaches the enlarged opening (64). Such opening permits use of a "C" washer clip (66) for engagement with the indented tip end of the pivot pin to thereby secure the fin to the plug means.

Fin (56) is designed to operate as an airfoil and stabilize the flight of the flying disc through the air. It includes a leading edge (68) to which is secured a counterbalance means shown as a streamlined or rounded weight (70). With a counterbalance located at the aforementioned leading edge, the center of gravity of the airfoil will be located forward of its mid-point. Preferrably, the length of the fin member does not exceed the diameter of the disc. This is to allow the disc periphery to act as a protection against damage to the fin when it hits the ground or an obstruction.

Figure 5:
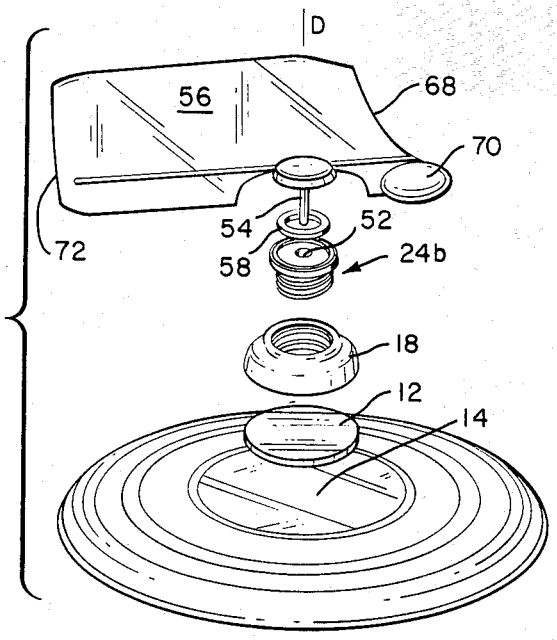
FIG. 5 is an exploded view of the fin assembly of FIG. 4.

In the preferred embodiment, the normal axis, shown in FIG. 5 by letter D, will extend through the airfoil centroid and the pivot pin (54) will be coextensive therewith. As so constructed, when the disc moves through the air, the airfoil will align itself so that its longitudinal axis will be in the direction of travel and the leading edge (68) will be at the front thereof.

To destabilize the above alignment and cause an erratic flight path, the trailing edge (72) of the airfoil may be provided with an adjustable rudder (74). The rudder is held in place by an elongated shaft (76) which extends through alternating aligned openings formed along the trailing edge (72) of the fin and along the front edge of rudder (74). It is expected that the rudder may be rotated about the aforesaid shaft and be maintained in a predetermined orientation as a result of a tight frictional engagement with the shaft.

To add further interest in use of the fin assembly, the counterbalance means may comprise a battery-powered light. Such could be used in place of the counterweight (70) and be rounded to have an aerodynamic shape. Preferably, the light, shown by reference numeral (78), will be self-contained and constructed in a manner well known in the art and be comparable to small pen lights, flashlights, or the like.

To insure that the flying characteristics of the subject disc toy are not detrimentally affected with the kit of the present invention, it is expected that the center of gravity of the dome light assembly, plug means and base housing will correspond with each of their respective longitudinal axis—shown by letters A and B in FIG. 3. Further, the assembly thereof will be such that the aforementioned axis will be coextensive with the disc normal axis, shown by letter C in FIG. 3, which, in turn, extends through the center of gravity of the flying disc. In this manner, the accessory kit, when assembled, will be centered and balanced on the disc in the same manner as the airfoil assembly.

In assembling the kit, the assembler will locate the normal axis of the flying disc toy. Such should extend through the planar top central portion of the disc. The base housing (18) will be centered thereover and secured at its bottom to the disc center portion by a pressure sensitive adhesive wafer (12) having peel-off covers (15) revealing adhesive on both sides thereof. Securing of the housing in this manner will then permit the assembler to either insert the dome light assembly housed by the sleeve-like plug means (24*a*), or the apertured plug means (24*b*). The housing will be common to both plug means and it is anticipated that the dome light assembly and airfoil assembly will be preassembled to the plug means so that all a user need do is simply screw the plug means into the common base housing.

In view of the above, it can be seen that a unique accessory kit is provided that can be used with typical flying disc toys. Lighting means are provided with both of the illustrated novelty devices so that the toy may be utilized in the dark. Further, the airfoil allows the flight path to be stabilized or an erratic pattern can be created to further enhance the saleability and interest of the toy. The kit can be used without permanent attachment or alteration to the flying disc and a common housing with simple exchange of plug means greatly simplifies the assembly of the kit.

While specific illustrative embodiments have been described, it will be apparent that other variations and/or modifications could be made without departing from the spirit and scope of the invention. Accordingly, it will be understood that the invention is not to be limited by the specific embodiments, but only by the scope of the appended claims.

I claim:

1. A kit for use with a flying disc toy comprising:
   - a flying disc;
   - a housing secured to the upper central portion of the flying disc with connector means, said housing including an opening in its top portion;
   - a plug means engaging said opening having a central aperture through which extends a pivot pin; and,
   - a rotatable aerodynamic fin member attached to said pivot pin being vertically disposed relative to the disc surface, said fin member including a leading edge and a trailing end with said leading edge having a counterbalance weight means, said pivot pin being connected to the fin member between the mid-point of said member and said leading edge.

2. The kit of claim 1 wherein the length of said fin member does not exceed the diameter of said disc.

3. The kit of claim 2 wherein said counterbalance weight means comprises a battery powered light.

4. The kit of claim 1 wherein the opening of said housing is internally threaded and the plug means is a sleeve having corresponding external threads.

5. The kit of claim 1 wherein the housing and plug means have a center of gravity along their respective longitudinal axis.

6. The kit of claim 5 wherein the longitudinal axis of said housing and said plug means are coextensive with the normal axis of said disc.

7. The kit of claim 1 wherein said trailing edge includes a rudder pivotably mounted thereon.

8. A novelty accessory kit for attachment to a toy flying disc comprising:

a flying disc;

a socket having a flat bottom surface with inwardly inclined upper sidewalls merging into a top opening;

a wafer having pressure sensitive adhesive on both sides, said wafer connecting said flat bottom surface to the top center portion of said disc;

a core member inserted into said top opening and releasably connected thereto, said core member having an interior cavity adapted to receive a dome light assembly comprising a battery and corresponding electrical conductor located within said cavity and a reflector with attached bulb and dome overlying said cavity.

9. The kit of claim 8 wherein said core member means includes an upper rim having resilient engagement means, the periphery of said dome being frictionally engaged therewith.

* * * * *